United States Patent [19]

Purcell

[11] Patent Number: 5,046,565

[45] Date of Patent: Sep. 10, 1991

[54] BLADE AND LINKAGE MECHANISM WITH DOWNDRAFT CONTROL

[76] Inventor: Robert J. Purcell, 409 Daniel Pkwy., Washington, Ill. 61571

[21] Appl. No.: 419,293

[22] Filed: Oct. 10, 1989

[51] Int. Cl.[5] ..... F41H 11/12; E02F 3/76

[52] U.S. Cl. ..... 172/239; 172/830; 172/832; 89/1.13

[58] Field of Search ..... 172/4.5, 239, 439, 445, 172/445.1, 701.1, 810, 811, 828, 830, 832, 779; 37/266, 270, 219, 234, 236, 272, 271, 273, DIG. 10; 89/1.13

[56] References Cited

U.S. PATENT DOCUMENTS

| | | | |
|---|---|---|---|
| 2,486,372 | 10/1949 | Rockwell | 248/1 |
| 2,511,123 | 6/1950 | Norris | 172/832 |
| 2,933,838 | 4/1960 | Rockwell | 172/239 |
| 3,005,275 | 10/1961 | Febre | 172/239 |
| 3,400,764 | 9/1968 | Schneider | 172/7 |
| 3,484,964 | 12/1969 | Jeffery, Jr. | 172/811 X |
| 4,013,307 | 3/1977 | Dowd et al. | 280/764 |
| 4,467,694 | 8/1984 | Azulai et al. | 172/828 X |
| 4,590,844 | 5/1986 | Bar-Nefy et al. | 89/1.13 |
| 4,690,030 | 9/1987 | Bar-Nefy et al. | 89/1.13 |
| 4,796,366 | 1/1989 | Scully | 37/4 |

FOREIGN PATENT DOCUMENTS

| | | | |
|---|---|---|---|
| 431295 | 8/1967 | Switzerland | 37/270 |
| 814290 | 3/1981 | U.S.S.R. | 172/701.1 |
| 857363 | 9/1981 | U.S.S.R. | 172/832 |

OTHER PUBLICATIONS

"Engineer Mineplough (EMP)", Brochure by Pearson Engrg. (Date & Author unknown).

*Primary Examiner*—Randolph A. Reese
*Assistant Examiner*—Jeffrey L. Thompson

[57] ABSTRACT

Blade mechanisms being operated along the ground have a tendency to draft into the ground unless some positive form of control is provided to prohibit the downdrafting of the blade. In the subject arrangement, a blade and linkage mechanism is provided for stopping a blade from drafting downward with respect to the ground. The linkage mechanism includes a tilt arm attached between a work vehicle and a top portion of the blade and a push arm attached between the work vehicle and a bottom portion of the blade. The tilt arm is movable relative to the vehicle through an arc which if extended intersects the push arm between its pivot connections. When the blade drafts downward, the different orientations of the tilt arm and the push arm corrects the downdraft due to the rear of a skid plate attached thereto being tilted with respect to the ground. The changing orientation of the skid plate with respect to the ground causes the front of the blade to raise with respect to the ground. Consequently, the problem of downward draft of the blade during operation is overcome without a complex mechanism.

14 Claims, 6 Drawing Sheets

BLADE AND LINKAGE MECHANISM WITH DOWNDRAFT CONTROL

DESCRIPTION

1. Technical Field

This invention relates generally to a linkage arrangement for supporting a blade on a vehicle and more particularly to a linkage arrangement which controls the tendency of the blade to draft into the ground.

2. Background Art

There are a variety of methods to correct the tendency for a blade to draft into the ground during use. Most methods involve manual operator correction through powered lifting. In many applications, the blade is held in a fixed position through the use of a control valve and associated components. Many times it is beneficial to allow the blade to "float" relative to the ground. In "float", the blade follows the contour of the ground without being forced to cut the ground at some desired height. Other systems use a skid shoe positioned adjacent the blade to keep the blade from drafting into the ground. These systems are deficient since the blade correction is based upon the skid shoe moving over ground that is outside of the area traversed by the blade and in many cases, the width of the blade is wider than the vehicle. Consequently, uneven ground under the skid shoe causes unwanted blade correction and the extra width of the blade may interfere with obstacles when the blade is being carried in the raised position. It is desirable to have a system that will automatically follow the contour of the ground being traversed by the blade while prohibiting the blade from drafting into the ground.

U.S. Pat. No. 3,400,764 which issued on Sept. 10, 1968 to Walter Schneider teaches a linkage arrangement for supporting one or more soil working implements. A lost motion linkage is used as a control member which actuates a main cylinder via a control valve to cause adjustment of the working implement. The lost-motion stroke allows the implement to rise and fall, depending on soil conditions, within a limited range without operator correction. Although this arrangement provides for automatic adjustment, it still relies on an input of power in order to correct downdraft of the implement.

U.S. Pat. No. 4,013,307 which issued on Mar. 22, 1977 to Allyn C. Dowd and John D. Rogowski teaches stabilizing arms for vehicles which are vertically movable from the transport position to the ground engagement position. The mounting apparatus may be adjusted to vary the angular disposition of the stabilizers relative to the vehicle. This apparatus provides ground engagement of the stabilizer pad at longitudinally spaced positions while still allowing full retraction of the stabilizers within the width of the vehicle.

U.S. Pat. No. 4,796,366 which issued Jan. 10, 1989 to Robert M. Scully teaches an earth mover vehicle that has a blade mounted on the front thereof. The blade can be positioned relative to the vehicle for use as a bulldozer blade, a cutting edge for a scraper bowl, or a bucket for hauling and dumping materials. The blade is movable to the various operating positions by a complex linkage arrangement.

A blade arrangement developed by Pearson Engineering and illustrated in a brochure (date of publication not available) teaches a mine clearing blade for use on a military tank. In this arrangement, the width of the blade is wide enough to remove any obstacles from the front of the respective vehicle tracks. This arrangement has a skid plate located adjacent the leading edge of the blade. Consequently the skid plate is subject to foreign obstructions and would not have the ability to closely control blade depth since the skid plate does not engage the terrain covered by the blade. In this arrangement, there are two blades, one in front of each track. The blades are raised and lowered together by a single hydraulic cylinder. Each blade extends beyond the width of the vehicle at all times.

The present invention is directed to overcoming one or more of the problems as set forth above.

DISCLOSURE OF THE INVENTION

In one aspect of the present invention a blade and linkage mechanism is provided for use on a work vehicle. The blade has an operating position at which the blade is in contact with the ground at a preselected operative level and is subject to downward draft in response to the blade being moved across the ground. The blade has a moldboard and top and bottom portions connected to and rearward of the moldboard. The blade and linkage mechanism includes a push arm and a tilt arm. The push arm has first and second end portions and is pivotally attached at the first end portion thereof to the bottom portion of the blade. The push arm is pivotally attached at the second end portion thereof to the work vehicle. The tilt arm has first and second end portions and is pivotally attached at the first end portion to the top portion of the blade. The tilt arm is pivotally attached at the second end portion to the work vehicle. The tilt arm is pivotal relative to the vehicle through an arc. When extended, the arc intersects the push arm between the pivot connections thereof with the blade and the vehicle so that operation of the blade below the preselected operative level results in a change in the preselected pitch angle.

This invention provides a blade and linkage mechanism which connects a blade to a work vehicle and is operative to control downdraft of the blade into the ground. The linkage mechanism is a passive control which does not require operator intervention. Furthermore, no active power input is required to reverse the downward draft of the blade. When the vehicle is travelling with the blade in the carry position, the outermost edge of the blade is within the outermost confines of the vehicle.

BEST MODE FOR CARRYING OUT THE INVENTION

Figure 1:
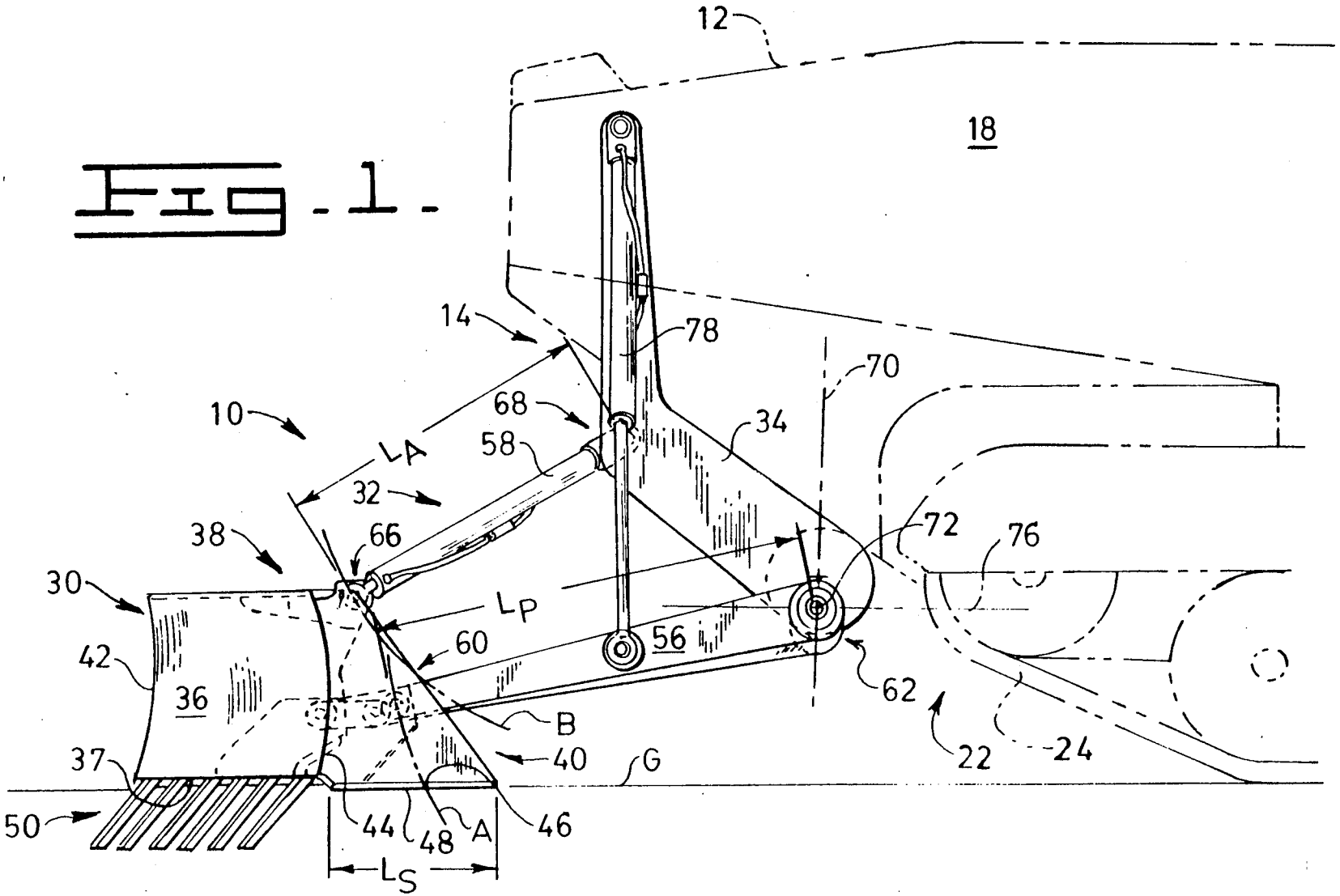
FIG. 1 is a side view of a blade and linkage mechanism incorporating an embodiment of the present invention with the blade in an operative position.
Figure 2:
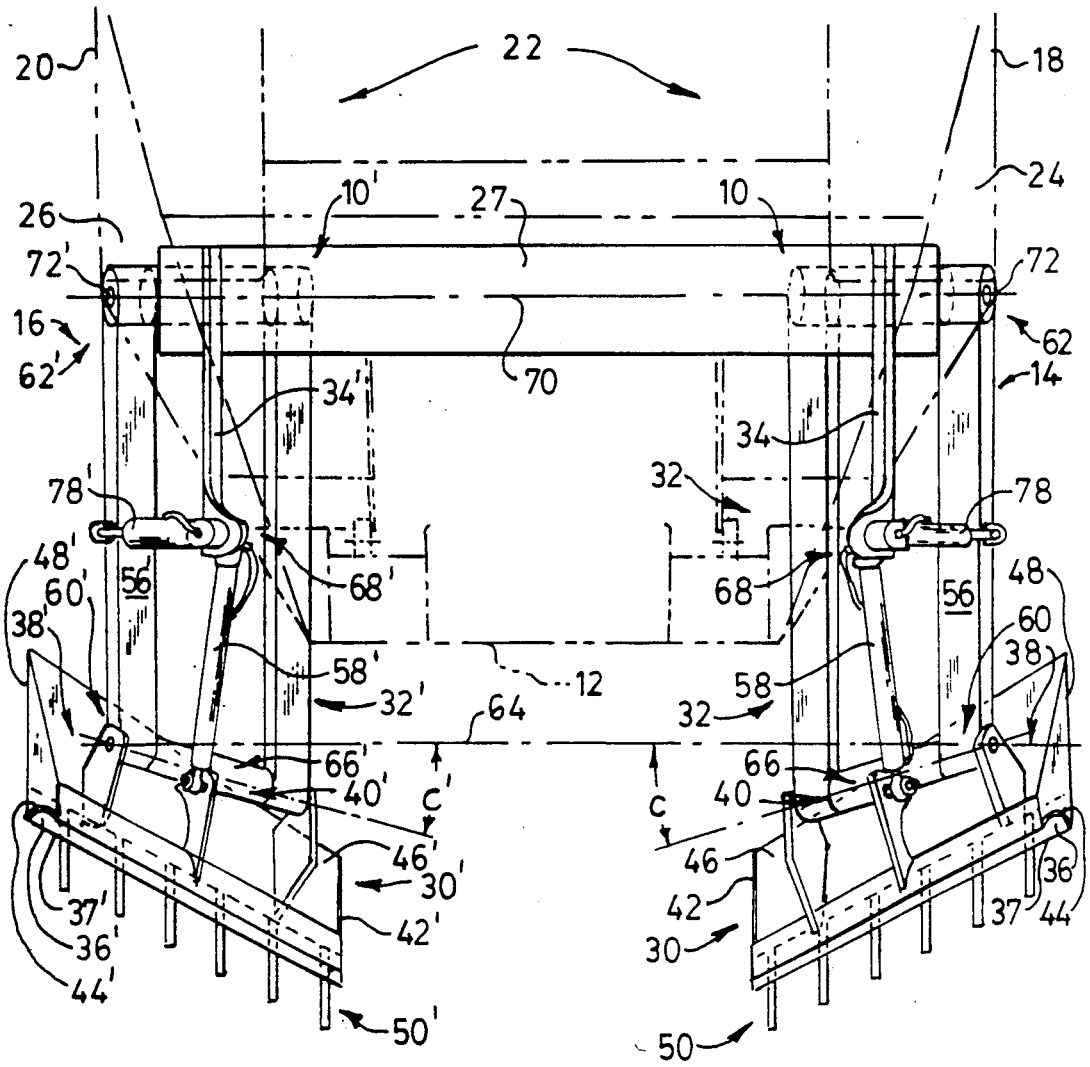
FIG. 2 is a top view of the blade and linkage mechanism of the present invention with the blade remaining in the operative position.
Figure 3:
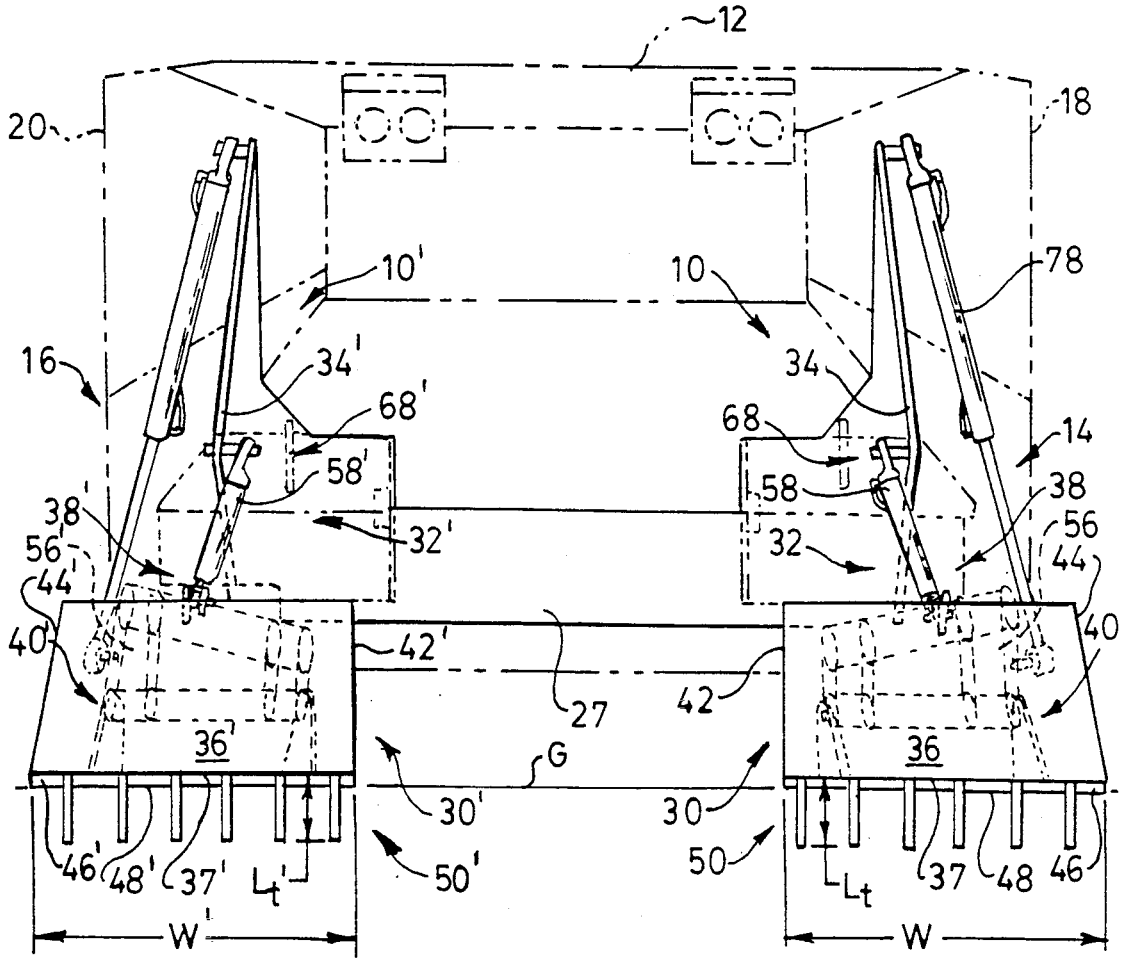
FIG. 3 is a front view of the blade and linkage mechanism of the present invention with the blade remaining in the operative position.

Referring now to the drawings, and more particularly to FIGS. 1, 2, and 3, a blade and linkage mechanism 10 is shown and adapted for use on a work vehicle 12. The work vehicle 12 has first and second front side portions 14, 16 and first and second outermost sides 18, 20. The work vehicle 12 also includes a vehicle carrier and propelling mechanism 22, for example, first and second endless track systems 24, 26.

As clearly shown in FIGS. 2 and 3, the work vehicle 12 includes a second blade and linkage mechanism 10' adapted for use thereon and connected to the first blade and linkage mechanism 10 by a beam member 27. Since each of the blade and linkage mechanisms 10, 10' are mirror images of each other, only the first one of the two will be discussed in detail. Each of the corresponding elements of the second blade and linkage mechanism 10' has the same element number as that of the first blade and linkage mechanism 10 with a prime symbol attached.

The first blade and linkage mechanism 10 includes a blade 30, a linkage mechanism 32, and a frame member 34. Even though the frame member 34 is noted as being part of the blade and linkage mechanism 10, it is well recognized that the frame member 34 could be an integral part of the frame of the work vehicle 12 without departing from the essence of the invention. The blade 30 includes a moldboard 36 with a bottom edge 37. The blade 30 also includes a top portion 38, a bottom portion 40, an innermost edge 42, and an outermost edge 44. The blade 12 has a predetermined width "W" and has an operating position at both a preselected operative level and a preselected pitch angle. During operation, the pitch angle of the moldboard 36 continually subjects the blade 30 to downdraft of the blade 30 below a surface "G". A skid plate 46 having a bottom surface 48 is connected to the moldboard 36 at and rearward of the bottom edge 37 thereof. The bottom surface 48 of the skid plate 46 has a predetermined shape and longitudinal length "$L_s$". In the preselected operative position of the subject embodiment, the skid plate 46 is substantially flat and parallel to the ground surface. The width of the skid plate is substantially the same as the width "W" of the blade 30. The blade 30 also includes a plurality of teeth 50 attached to the bottom portion 40 thereof and behind the moldboard 36. Each tooth of the plurality of teeth 50 has a predetermined length "$L_t$".

The linkage mechanism 32 includes a push arm 56 and a tilt arm 58. The push arm 56 has a first end portion 60 pivotally connected at spaced locations to the bottom portion 40 of the blade 30. The push arm 56 also includes a second end portion 62 pivotally connected to the frame member 34. The connection of the first end portion 60 of the push arm 56 with the bottom portion 40 of the blade 30 is movable, with respect to the frame member 34, through an arc "C". As shown in FIG. 2, a transverse vertical plane 64 is defined with respect to the front of the vehicle 12 and intersects the pivotal connection of the push arm 56 with the bottom portion 40 of the blade 30. The pivotal connection of the push arm 56 with the bottom portion 40 of the blade 30 forms an acute angle with the transverse vertical plane 64. The pivotal connection of the push arm 56 with the bottom portion of the blade 30 is substantially parallel with the surface "G" of the ground when the blade 30 is in its preselected operative position. The push arm 56 also has a preselected length "$L_p$".

The tilt arm 58 has a first end portion 66 pivotally connected to the top portion 38 of the blade 30. The tilt arm also has a second end portion 68 pivotally connected to the frame member 34. The pivotal connection of the tilt arm 58 to the frame member 34 and the blade 30 are universally connected. It is recognized that other types of connections could be utilized. The tilt arm 58 has a preselected length "$L_1$" which is less than the length of the push arm 56. The connection of the first end portion 66 of the tilt arm 58 is movable through an arc "B" relative to the frame member 34 such that if extended, the arc "B" would intercept the push arm 56 between its respective points of connection with the blade 30 and the frame member 34.

As further shown in FIG. 2, a second transverse vertical plane 70 is defined in the work vehicle 12 and it intersects the pivotal connection of the push arm 56 with the frame member 34. The push arm 56 is pivotally connected to the frame member 34 by a mounting pin 72 secured thereto. The mounting pin 72 is secured to the frame member 34 in substantial alignment with the transverse vertical plane 70.

Figure 4:
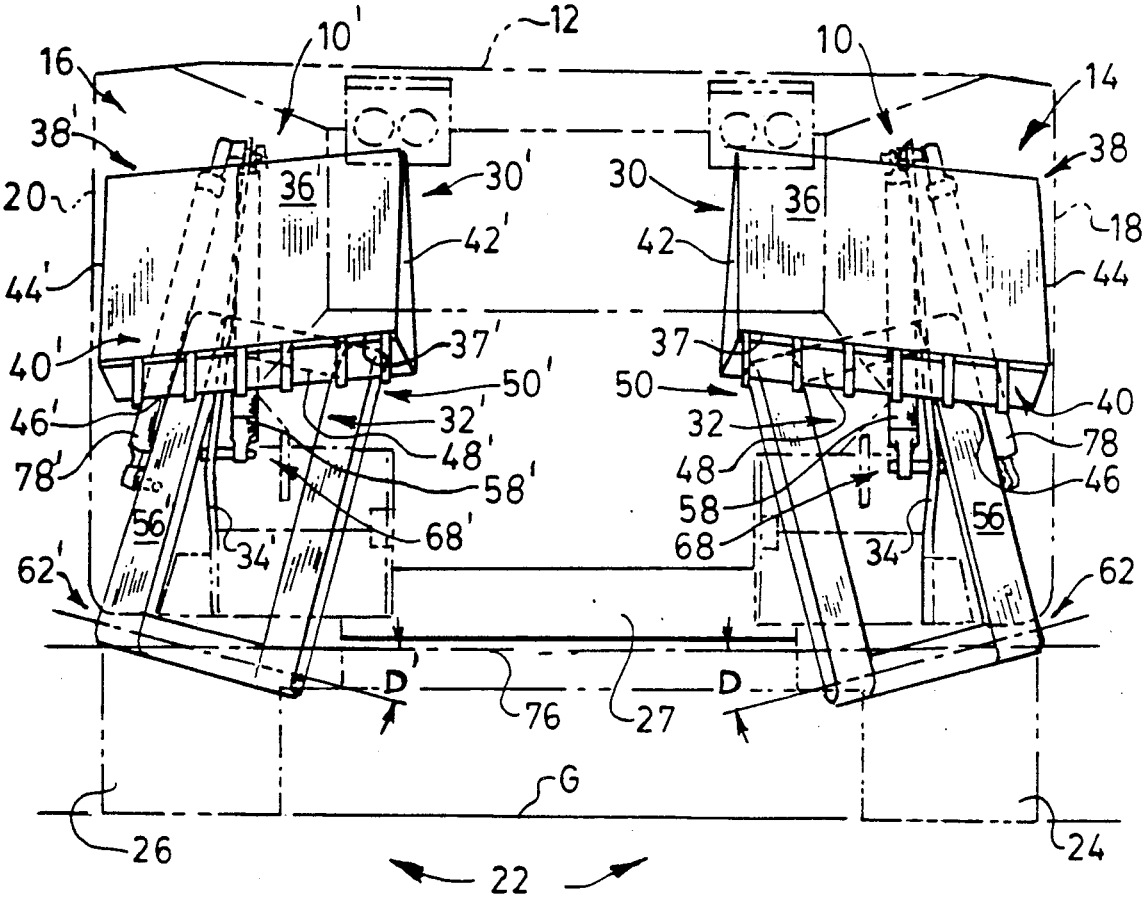
FIG. 4 is a front view of the blade and linkage mechanism of the present invention with the blade in the carry position.

Referring to FIG. 4, a transverse horizontal plane 76 is defined in the work vehicle 12 perpendicular to the second transverse vertical plane 70. The transverse horizontal plane 76 also intersects the pivotal connection of the push arm 56 with the frame member 34. An acute angle "B" is formed between the mounting pin 72 and the transverse horizontal plane 76.

A lift cylinder 78 is connected to the frame member 34 and the push arm 56. The lift cylinder 78 is operative to raise the blade 30 from the operative position illustrated in FIGS. 1, 2, and 3 to the carry position as illustrated in FIG. 4. Furthermore, the lift cylinder 78 is a single acting cylinder which is raised by a power input and allowed to float when operated in the lowered position. As further illustrated in FIG. 4, with the blade 30 in a carry position, the outermost edge 44 thereof is within the first outermost side 18 of the work vehicle 12.

Figure 5:
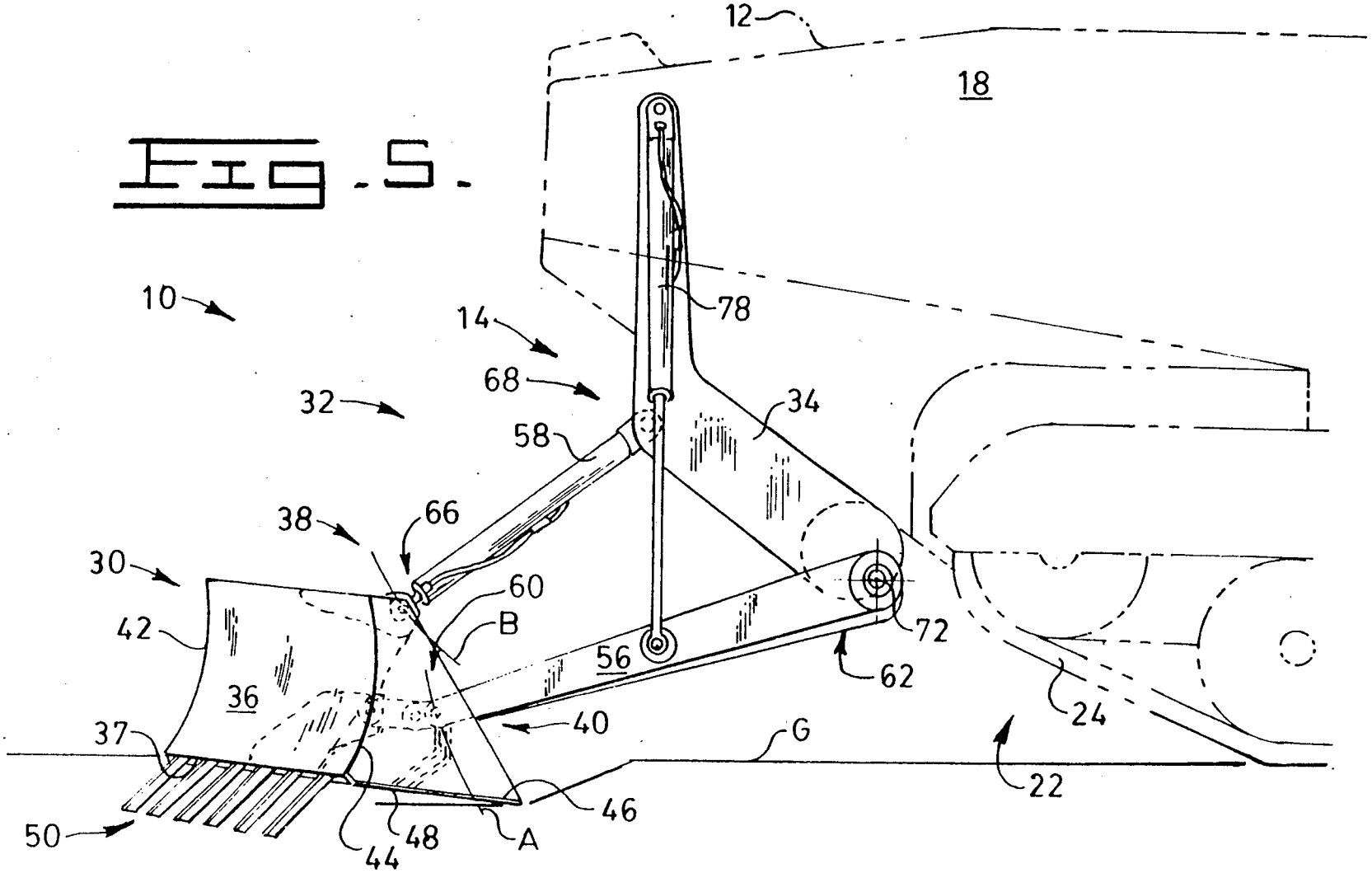
FIG. 5 is a side view of the blade and linkage mechanism of the present invention in a position lower than the operative position.

FIG. 5 illustrates the blade and linkage mechanism 10 in a position where the blade 30 has downdrafted below the preselected operative position. For clarity, the degree of downdraft has been exaggerated. As clearly shown, the back end of the skid plate 46 is being pressed against the ground causing the front end of the blade 30 to raise with respect to the ground. This action effectively, automatically compensates for the downdraft condition and returns the blade 30 to the preselected operative position.

Figure 6:
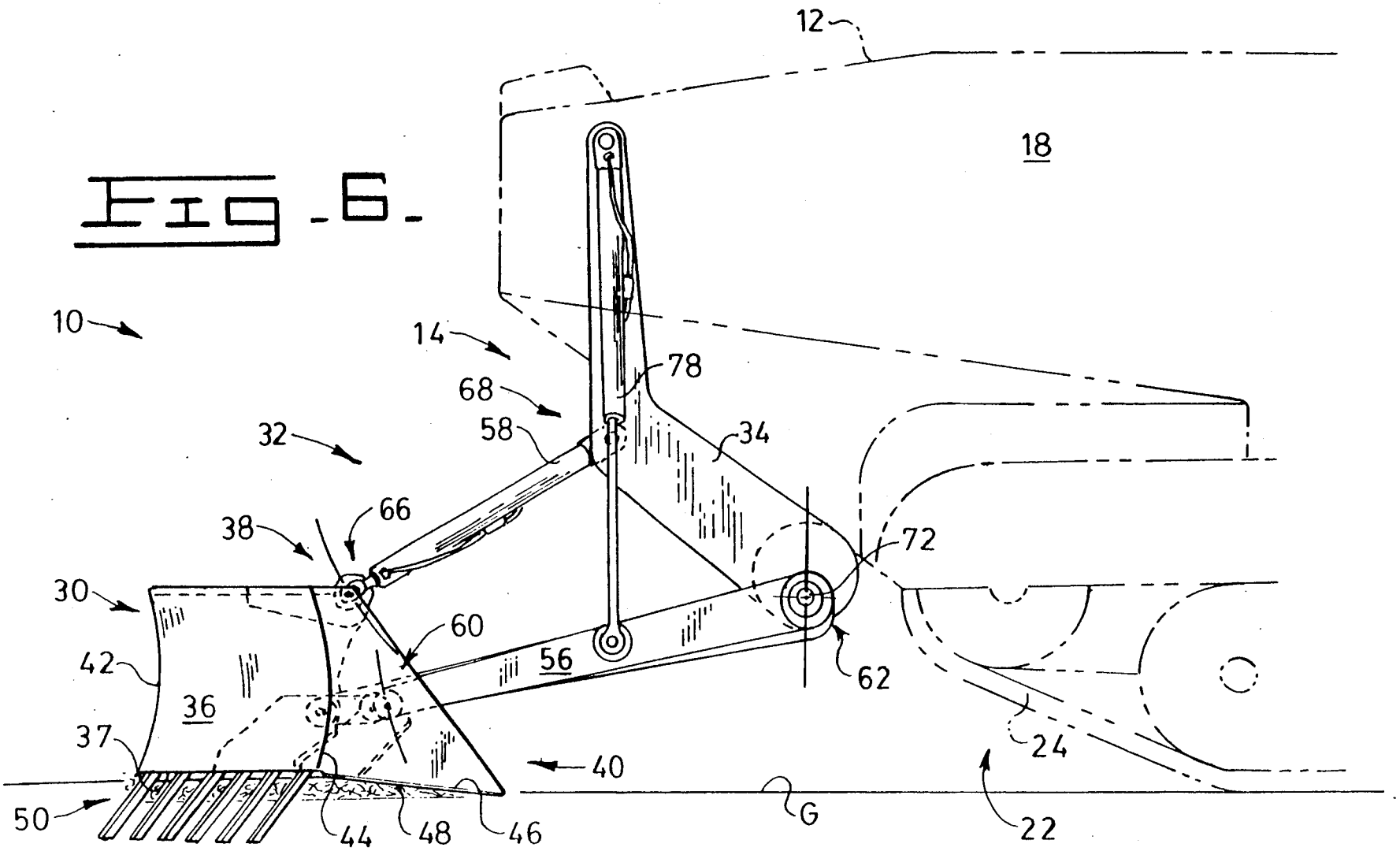
FIG. 6 is a side view of an alternate embodiment of the blade and linkage mechanism of the present invention with the blade in the operative position.

FIG. 6 illustrates an alternate embodiment of the blade and linkage mechanism 10 as set forth above. In this arrangement, the linkage mechanism 32 is the same as previously described. The major difference of this embodiment is the skid plate 46. In various applications, the plurality of teeth 50 break up the soil of the ground to such a degree that the soil builds up in front of the blade 30. In the subject arrangement, the bottom surface 48 of the skid plate 46 is angled downwardly and rearwardly from the bottom edge 37 of the moldboard 36. The angle of downward projection with respect to the surface of the ground and the vertical depth of downward projection depends on the type of soil being worked. As an example, a typical skid plate 46 has a 6 degree angle with the surface of the ground and extends 50 mm (approximately 2 inches) below the initial unworked surface of the ground. This shape provides adequate compaction of the soil to sustain the weight of the blade 30 and to maintain the blade 30 in the preselected operative position.

It is recognized that various forms of the blade and linkage mechanism 10, 10' could be utilized without departing from the essence of the invention. As previously noted, the frame member 34 could be an integral portion of the frame of the work vehicle 12. Furthermore, the tilt arms 58 could be an adjustable member such as a hydraulic cylinder for changing the pitch of the moldboard 36 during various operating conditions. Likewise, the plurality of teeth 50 could be adjustable in length to compensate for working in differing types of materials and the skid plate 46 could be narrower than the width of the blade 30.

INDUSTRIAL APPLICABILITY

In the operation of the blade and linkage mechanism 10, as illustrated in FIG. 1 through 5, the blade 30 is traversing the surface "G" of the ground with the plurality of teeth 50 attached thereto submerged in the ground. Simultaneously, the skid plate 46 is sliding across the top of the ground and maintaining the blade 30 at a depth equivalent to the preselected operative position. Since due to the curvature of the moldboard 36, the preselected pitch angle of the blade 30, and the penetration of the plurality of teeth 50, the blade 30 is continually subjected to forces causing downdraft of the blade 30 into the ground. The only thing stopping the downdraft of the blade 30 into the ground is the skid plate 46 and the corrective action of the linkage mechanism 32. This is true since the lift cylinder 78 is a single acting cylinder which has power available only to raise the blade 30. In this system, the blade 30 is continually in the "float" position when it is being operated in the down or lower position.

As more clearly shown in FIG. 5, any movement of the blade 30 downwardly from the preselected operative position results in the preselected pitch angle of the moldboard 36 changing. The changing of the pitch angle from its preselected position results in the bottom surface 48 of the skid plate 46 changing from the horizontal position parallel to the surface "G" of the ground to a position that is not parallel to the ground surface. This change in position of the bottom surface 48 causes the back end of the skid plate 46 to be lower than the front end of the skid plate 46. Since the rear end of the skid plate 46 is in contact with the ground and cannot penetrate the ground, the front portion of the skid plate 46 and the moldboard 36 are raised with respect to the ground. Since the bottom edge 37 of the moldboard 36 is raised, the portion of the ground being subjected to the bottom edge 37 of the moldboard 36 is higher. Consequently, the bottom surface 48 of the skid plate 46 slides onto the higher ground surface which automatically raises the blade 30 to its preselected operative position. Any further downdrafting of the blade 30 from the preselected operative position automatically results, as set forth above, in the linkage mechanism 32 functioning to return the blade 30 to its preselected operative position.

The upward movement of the blade 30, resulting from the rear end of the skid plate 46 causing the front end thereof to raise up, is attributed to the linkage mechanism 32. More specifically, any downward rotation of the push arm 56 and the tilt arm 58 through the respective arcs "A, B" result in the connection point of the tilt arm 58 to the top portion 38 of the blade 30 moving rearwardly with respect to the connection point of the push arm 56 with the bottom portion 40 of the blade 30. Referring to FIGS. 1 and 5, the paths followed by the tilt arm 58 and the push arm 56, during downdrafting of the blade 30, are clearly illustrated by the pre-established arcs "A and B".

Referring to FIGS. 2 and 3, the width "W" of the blade 30 is sufficient to cover the portion of the ground traversed by the first endless track system 24. Furthermore, the outermost edge 44 of the blade 30 extends beyond the first outermost side 18 of the work vehicle 12 when the blade and linkage mechanism 10 is being operated in the preselected operative position. As illustrated in FIG. 4, the outermost edge 44 of the blade 30 is substantially within the first outermost side 18 of the work vehicle 12 when the blade and linkage mechanism 10 is in the carry position. The ability to have the blade 30 extend beyond the first outermost side 18 of the work vehicle 12 during operation and to have the outermost edge 44 positioned within the first outermost side 18 when in the carry position is attributed to the connection of the push arm 56 to the frame member 34. By having the mounting pin 72 at an acute angle "O" with respect to the transverse horizontal plane 76, the blade 30 is automatically positioned inwardly with respect to the work vehicle 12. Furthermore, by having the connection of the push arm 56 with the blade 30 at an acute angle "C" with the first transverse vertical plane 64, the bottom of the blade 30 is maintained, when in the carry position, generally parallel with the ground. Therefore, the work vehicle 12 can traverse terrain having obstacles on either side without worry of the blade 30 striking the obstacles.

The second blade and linkage mechanism 10, functions identically to the first blade and linkage mechanism 10. The first and second blade and linkage mechanisms 10, 10' are effective to allow the blades 30, 30' to operate in the float position for clearing obstacles from the path of the first and second endless track systems 24, 26 while automatically controlling downdraft of the respective blades 30, 30'. Furthermore, the blades 30, 30' are positioned within the outermost sides 18, 20 of the work vehicle 12 when they are raised to the carry position.

Other aspects, objects, and advantages of this invention can be obtained from the study of the drawings, the disclosure, and the appended claims.

I claim:

1. A blade and linkage mechanism adapted for use on a work vehicle includes a blade having an operating position at which the blade is in contact with the surface of the ground at both a preselected operative position and a preselected pitch angle and is subject to downdraft in response to the blade being moved across the ground, said blade has a moldboard, a top portion and a bottom portion connected to and rearward of the moldboard, and a skid plate having a bottom surface of a predetermined shape and being connected to the bottom portion of the blade, said linkage mechanism has a push arm having first and second end portions and being pivotally attached at the first end portion to the bottom portion of the blade and pivotally attached at the second end portion thereof to the work vehicle and a tilt arm having first and second end portions and being pivotally attached at the first end portion to the top portion of the blade and pivotally attached at the second end portion to the work vehicle, the tilt arm being pivotal relative to the vehicle through an arc that when extended intersects the push arm between the pivot connections thereof with the blade and the work vehicle so that operation of the blade below the preselected operative position results in a change in the preselected pitch angle, the blade and linkage mechanism comprising:

the blade and linkage mechanism being attachable to one front side portion of the vehicle and selectively movable between the preselected operative position and a carry position, the axis of the pivotal connection of the push arm to the vehicle is disposed at an acute angle with respect to a transverse horizontal plane of the vehicle and the axis of the pivotal connection of the push arm to the blade is at an acute angle with a transverse vertical plane.

2. The blade and linkage mechanism, as set forth in claim 1, wherein the blade has an outermost edge and when operated at the preselected operative level, the acute angles of the axes of the pivotal connections of the push arm with the vertical and horizontal planes maintains the outermost edge of the blade at a location outside of a line defining an outermost side of the vehicle and when the blade is in the carry position, the acute angles of the axes of the pivot connections of the push arm to the vertical and the horizontal planes of the vehicle maintains the outermost edge of the blade within the line defining the outermost side of the vehicle.

3. The blade and linkage mechanism, as set forth in claim 2, including a frame member connectable to the work vehicle and wherein the second end portion of the push arm is connected to the frame member and the second end portion of the tilt arm is connected to the frame member at a location spaced from the connection of the push arm to the frame member.

4. The blade and linkage mechanism, as set forth in claim 3, wherein the moldboard has a bottom edge and the blade includes a plurality of teeth attached to and extending from the bottom portion of the blade at spaced apart locations along the bottom portion of the blade behind the bottom edge of the moldboard.

5. The blade and linkage mechanism, as set forth in claim 4, wherein the work vehicle includes a vehicle carrier and propelling mechanism and the blade has a width sufficient to clear a path wider than a path traveled by the vehicle carrier and propelling mechanism.

6. The blade and linkage mechanism, as set forth in claim 5, wherein the vehicle carrier and propelling mechanism includes first and second endless track systems and the blade clears a path for the first endless track system.

7. The blade and linkage mechanism, as set forth in claim 6, including a second blade and linkage mechanism attachable to the second front side portion of the vehicle, the second blade and linkage mechanism being a substantially identical mirror image of the first blade and linkage mechanism and operative to clear a path for the second endless track system.

8. The blade and linkage mechanism, as set forth in claim 7, wherein the skid plate of each of the blade and linkage mechanisms has a predetermined longitudinal length and during operation of the respective blades, at both the preselected pitch angle and the preselected operative position, the bottom surface of the respective skid plates is substantially parallel to the surface of the ground.

9. The blade and linkage mechanism, as set forth in claim 1, wherein the blade includes a plurality of teeth attached to and extending from the bottom portion thereof at spaced apart locations therealong, the bottom surface of the skid plate is angled downwardly and rearwardly with respect to the surface of the ground when the blade is in the preselected operative position and during operation compacts the soil loosened by the plurality of teeth to maintain the blade at the preselected operative position.

10. The blade and linkage mechanism, as set forth in claim 9, wherein the angle of the skid plate with respect to the surface of the ground is approximately 6 degrees.

11. The blade and linkage mechanism, as set forth in claim 10, wherein the rear end portion of the skid plate is positionable with respect to the ground below the initial unworked surface of the ground approximately 50 mm and is operative to maintain the blade in its preselected operative position.

12. A blade and linkage mechanism adapted for use on a work vehicle includes a blade having an operating position at which the blade is in contact with the surface of the ground, said blade has a moldboard, a top portion and a bottom portion connected to and rearward of the moldboard, said linkage mechanism has a push arm having first and second end portions and being pivotally attached at the first end portion to the bottom portion of the blade and pivotally attached at the second end portion thereof to the work vehicle and a tilt arm having first and second end portions and being pivotally attached at the first end portion to the top portion of the blade and pivotally attached at the second end portion to the work vehicle, the blade and linkage mechanism comprising:

the blade and linkage mechanism being attachable to one front side portion of the vehicle and selectively movable between the preselected operative position and a carry position, the axis of the pivotal connection of the push arm to the vehicle is disposed at an acute angle with respect to a transverse horizontal plane of the vehicle and the axis of the pivotal connection of the push arm to the blade is at an acute angle with a transverse vertical plane.

13. The blade and linkage mechanism, as set forth in claim 12, wherein the blade has an outermost edge and when operated at the preselected operative level, the acute angles of the axes of the pivotal connections of the push arm with the vertical and horizontal planes maintains the outermost edge of the blade at a location outside of a line defining an outermost side of the vehicle and when the blade is in the carry position, the acute angles of the axes of the pivot connections of the push arm to the vertical and the horizontal planes of the vehicle maintains the outermost edge of the blade within the line defining the outermost side of the vehicle.

14. The blade and linkage mechanism, as set forth in claim 13, including a second blade and linkage mechanism attachable to the second front side portion of the vehicle, the second blade and linkage mechanism being a substantially identical mirror image of the first blade and linkage mechanism.

* * * * *

UNITED STATES PATENT AND TRADEMARK OFFICE

CERTIFICATE OF CORRECTION

PATENT NO. : 5,046,565

DATED : September 10, 1991

INVENTOR(S) : ROBERT J. PURCELL

It is certified that error appears in the above-identified patent and that said Letters Patent is hereby corrected as shown below:

Column 1, after title, please insert:

--This invention was made with Government support under contract number N61331-89-C-0011 awarded by Naval Coastal Systems Center. The Government has certain rights to this invention.--

Signed and Sealed this

Eighth Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,046,565

DATED : September 10, 1991

INVENTOR(S) : Robert J. Purcell

It is certified that error appears in the above-identified patent and that said Letters Patent is hereby corrected as shown below:

On title page of patent, please insert:
--[73] Assignee: Caterpillar Inc., Peoria, Ill.--.

On title page of patent, under "ABSTRACT", line 10 after "blade.", please insert:
--The push arm is pivotally attached to the work vehicle about an axis disposed at an acute angle to a horizontal plane and to the blade about an axis disposed at an acute angle to a transverse vertical plane.--

Signed and Sealed this

Sixteenth Day of March, 1993

*Attest:*

STEPHEN G. KUNIN

*Attesting Officer*

*Acting Commissioner of Patents and Trademarks*